United States Patent [19]

Ehrenfried

[11] Patent Number: 4,647,040

[45] **Date of Patent: * Mar. 3, 1987**

[54] LEG STRETCHING APPARATUS

[75] Inventor: Ted R. Ehrenfried, Newport News, Va.

[73] Assignee: Treco Products Inc., Newport News, Va.

[ * ] Notice: The portion of the term of this patent subsequent to Jun. 26, 2001 has been disclaimed.

[21] Appl. No.: 515,976

[22] Filed: Jul. 21, 1983

Related U.S. Application Data

[63] Continuation-in-part of Ser. No. 362,561, Mar. 26, 1982, Pat. No. 4,456,247.

[51] Int. Cl.[4] ..... A63B 21/00; A61H 1/02

[52] U.S. Cl. ..... 272/126; 272/144; 128/75

[58] Field of Search ..... 272/93, 116, 125, 144, 272/126, 130, 135, DIG. 10; 128/25 R, 69–75, 84 R, 84 C

[56] References Cited

U.S. PATENT DOCUMENTS

| | | | |
|---|---|---|---|
| 3,699,953 | 10/1972 | Mason | 128/75 |
| 3,868,951 | 3/1975 | Albrecht | 128/84 C X |
| 3,871,366 | 3/1975 | Cotrel | 128/84 C X |
| 4,125,258 | 11/1978 | McArthur | 272/144 X |
| 4,240,627 | 12/1980 | Brentham | 272/134 X |
| 4,354,485 | 10/1982 | Safadago | 128/70 |
| 4,360,009 | 11/1982 | Weisman | 128/71 |

OTHER PUBLICATIONS

"Black Belt"-Black Magazine, p. 17, (Stretching Machine) May 1980.

"Hurley"-Black Belt Magazine, Feb. 1982, vol. 20, #2, p. 17.

*Primary Examiner*—Richard J. Apley

*Assistant Examiner*—Robert W. Bahr

*Attorney, Agent, or Firm*—Stevens, Davis, Miller & Mosher

[57] ABSTRACT

Disclosed are two separate leg supporting members which are independently and pivotally connected to a base assembly. At their pivotal connection with the base assembly, they are further provided with a torque disk assembly having cables attached thereto. In a preferred embodiment, the cables are merely segments of a single cable which travels from one torque disk assembly through a guide around a pulley back through the guide to the other torque disk assembly. As the pulley is moved away from the guide, the cable causes the torque disk assemblies to rotate, forcing the two leg supporting members apart, stretching the legs of the user into a "split" position. The fact that the cable is free to move around the pulley permits the leg supporting members while maintaining the angle therebetween substantially constant. Additionally, a shift selector is provided which can controllably lock either of the leg supporting members into a fixed position with respect to the base assembly so that the machine may be utilized in the single leg mode of operation. The pulley is moved with respect to the guide through the use of a worm gear which is rotated by turning of a crank handle. The worm gear threads are chosen so as to prevent movement of the crank handle under the tension placed upon the pulley.

24 Claims, 7 Drawing Figures

LEG STRETCHING APPARATUS

This is a continuation-in-part of Ser. No. 362,561 filed Mar. 26, 1982, now U.S. Pat. No. 4,456,247.

BACKGROUND OF THE INVENTION

The present invention relates generally to athletic equipment and relates specifically to improvements in a leg stretching apparatus.

Runners, martial arts practitioners, dancers and gymnists require flexibility in the groin and quadricep muscles. One exercise often used to improved the flexibility of these muscles is the spreading apart of one's legs into a so-called "split" position. Here, the individual's torso is either sitting or reclining and the legs are pointing at essentially right angles to the torso and 180 degrees with respect to each other. The flexibility necessary to achieve this position is generally achieved through various stretching exercises.

In a copending patent application, entitled: LEG STRETCHING APPARATUS, filed Mar. 26, 1982, and granted Ser. No. 362,561, now U.S. Pat. No. 4,456,247 on behalf of the present inventor, discloses a number of prior art devices intended to achieve such flexibility but with various drawbacks associated therewith. In application Ser. No. 362,561, a unique leg stretching apparatus is disclosed which utilizes a crank assembly for providing large-scale stretching movement of the leg supports and a column assembly to provide a minor amount of leg stretching movement to the leg supports in order to achieve the maximum desired stretch without the very real possibility of exceeding the stretch limits, causing pain and injury to the user of the apparatus. Although this device has achieved substantial commercial success and has been marketed worldwide and been critically acclaimed in such publications as "*Black Belt*", and "*Runner's World*", there are several minor aspects which could improve the utility of a leg stretching system which have not been heretofore included.

First, it is desirable to be able to stretch only one leg relative to the torso and the other leg. This would be highly desirable in the instance in which one leg has been injured to a minor degree and the individual wishes to maintain a certain level of flexibility during the recuperation period.

A major advantage of the above-referenced application is the ability for the user of the apparatus to have complete confidence in his control of the amount of the stretch, allowing all muscles to be completely relaxed obtaining the best stretching benefit from the machine. During such a stretch, it would be desirable to be able to move the leg supports in the plane of the legs relative to the user's torso. In other words, while maintaining the stretch or the angle between individual leg supports, it would be useful to be able to perform a twisting movement about the torso in order to improve torso flexibility relative to the leg stretch.

Because in the referenced application, the tensioning cables from each disk assembly are wound on a drum assembly which is fixed, there can be no movement of the leg supports unless the crank is operated or the crank assembly is pivotally moved. Furthermore, if one leg support is locked into position, the other leg assembly will also be fixed in that position and the crank operation and crank assembly pivoting movement will be unable to move either leg support. Consequently, the referenced patent application, herein incorporated by reference, cannot provide the above desirable stretching movements, and these are certainly not provided in a suitable manner in the prior art reviewed to date.

SUMMARY OF THE INVENTION

Therefore, in view of the above and other disadvantages of prior art leg stretching apparatuses, it is an object of the present invention to provide a leg stretching apparatus in which all cables are concealed within the base and/or crank assembly of the device.

It is a further object of the present invention to provide a leg stretching apparatus in which pulleys previously located at the rear portion of the base can be eliminated, allowing leg support members to be folded into the base for compact storage.

An additional object of the present invention is to provide a leg stretching apparatus which, while providing a desired angle of stretch between legs, permits the legs to freely pivot with respect to the torso while maintaining the angle of stretch.

It is an additional object of the present invention to provide a single leg support locking structure which will fix one leg support in position with respect to the apparatus and the torso while allowing stretching movement of the other leg support to take place in the normal controlled manner.

It is a further object of the present invention to provide a leg stretching apparatus utilizing a crank assembly for providing a large-scale stretching movement of leg supports and to provide a further structure for applying minute and controlled leg stretching movements to the leg support structure while at the same time allowing for stretching movement of only one leg support with the other leg support locked in a desired position with respect to the user's torso and the apparatus.

It is a still further object of the present invention to provide a leg stretching apparatus utilizing a crank assembly for providing large-scale stretching movement of leg supports and to provide a further apparatus for applying minute and controlled stretching movements to the leg supports in which the leg supports are free to pivot while maintaining the stretch angle determined by the crank assembly and the further apparatus.

The above and other objects are achieved in accordance with the present invention by providing a torso restraining member in the form of a seat and pivotally mounting two leg supporting members thereto. Each of the leg supports, in a preferred embodiment, has a disk segment attached thereto with a groove in the outer periphery thereof. A cable is attached to the disk, such that when the cable is pulled in the forward direction (away from the user) the leg support associated with the disk is pivoted rearward biasing a leg mounted in the support into a "split" position. Whereas, in the aforementioned copending application, the cables from each disk assembly pass through a guide and extend to a conventional crank and drum assembly, in the present improvement, the cable from one disk assembly merely goes through the guide up and around a movable pulley and back down through the guide to the other disk assembly. Thus, when the movable pulley is raised (moved away from the guide), the disks will be rotated towards the "split" position. However, since the movable pulley is also free to rotate, with a very slight user-supplied force on one of the leg supports, the leg supports can be moved from side to side in a "twisting" manner while maintaining the "split" angle therebetween. As in the aforementioned patent application, the major amount of stretching movement towards the "split" position is provided by a crank assembly and the minor or adjustment stretching movement is provided by pivotally moving the crank assembly and the resultant pulling on the cables by the guides.

BRIEF DESCRIPTION OF THE DRAWINGS

A more complete appreciation of the invention, and many of the attendant advantages thereof, will be readily apparent by reference to the accompanying Drawings, wherein.

DETAILED DESCRIPTION OF PREFERRED EMBODIMENTS

Figure 1:
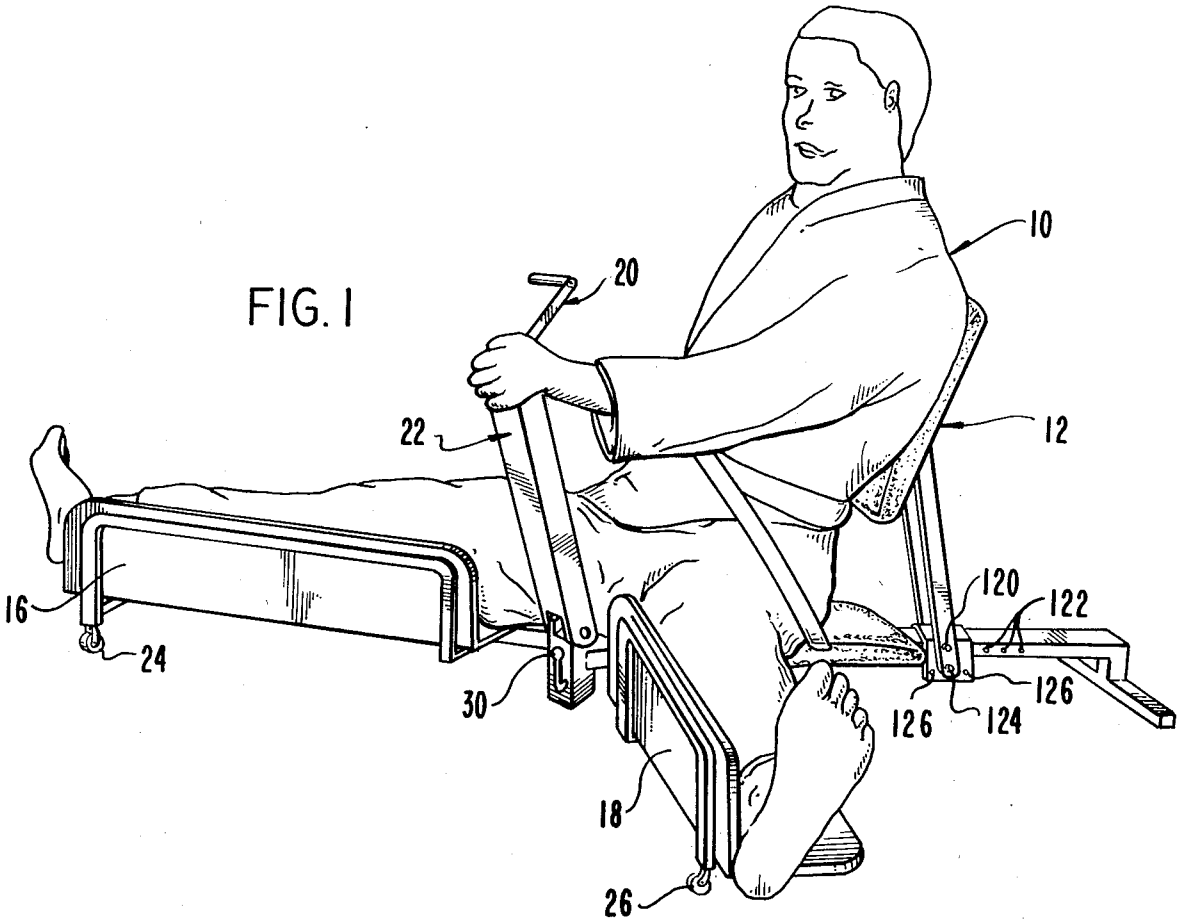
FIG. 1 is a perspective view of an individual using the present invention.

Referring now more particularly to the Drawings, wherein like numerals represent like elements throughout the several views, FIG. 1 generally shows the operator, position and use of the leg stretching apparatus. The operator 10 is seated on the torso restraining means comprised of seat assembly 12 and base assembly 14. The operator's legs are placed in the leg supporting means 16 and 18, which are spread apart through the action of crank 20 and the pivoting of crank assembly housing 22, as will be seen more clearly in later figures. Movement of the leg supporting means is aided through the use of wheel means 24 and 26.

Although construction can be by use of the generally wooden materials disclosed in the above-referenced copending application, applicant has found it advantageous to utilize a welded steel tube frame which is padded where appropriate. Other materials, such as aluminum tubing, fiberglas reinforced plastic (FRP), etc. can be used to good effect in the present invention. Given the orientation of loads, as set forth in the copending application, and the forces generated, one of ordinary skill in the art could easily design an adequate frame in accordance with the present invention utilizing almost any known structural material. Inasmuch as the particular structural material chosen is not critical to the present invention, no further discussion or disclosure of the structure will be given, except as it interacts with specific features of the present invention.

Figure 2A:
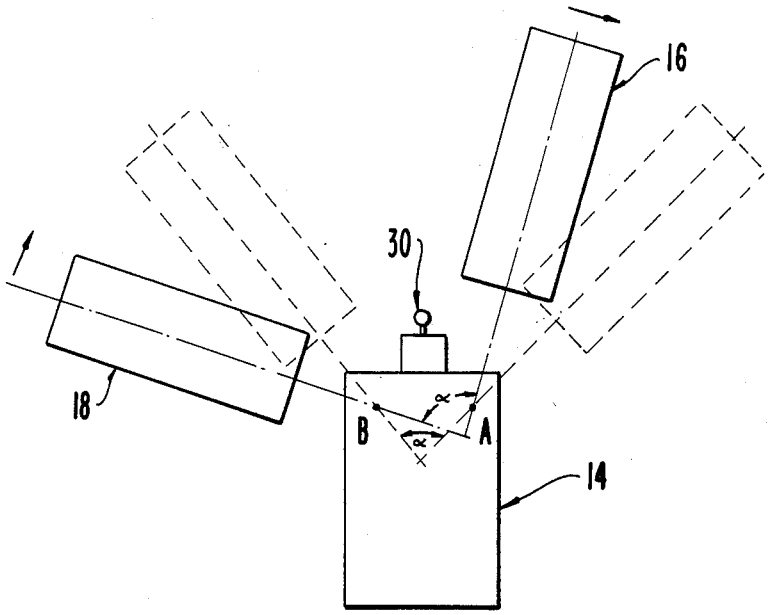
FIG. 2A is a top representational view of the present invention operating in the fixed angle twist mode of operation.

The differing modes of operation are defined as follows and are illustrated by reference to the above-identified copending patent application and FIGS. 2A and 2B. In FIG. 2A, shift selector 30 is in the upright, or center position, which means that when crank 20 is operated and when crank assembly housing 22 is pivoted, the angle between leg supporting means 16 and leg supporting means 18 will change in the manner set forth in the copending patent application and as clarified subsequently in this application. However, neither leg supporting means is constrained against movement in the plane of the leg supporting means, and thus leg supporting means 16 and 18 can be pivoted about their respective pivot points A and B. However, without operation of crank 20 or pivoting of crank assembly housing 22, the angle $\alpha$ between the leg supporting means will remain substantially constant. This angle is the amount of stretch in the "split" position.

Thus, in the mode of operation described with reference to FIG. 2A, i.e., the "twist" mode of operation, a desired amount of stretch can be achieved by means of crank operation and pivoting of the crank assembly housing and while holding this degree of stretch, the operator can swing his legs to the left (as shown in solid lines in FIG. 2A), to the center (as shown in phantom lines in FIG. 2A), or to the right (not shown) with complete ease. Note that the shift selector 30 is in the upright position, indicating that both legs will be biased evenly with respect to crank operation and crank assembly housing pivotal movement.

Figure 2B:
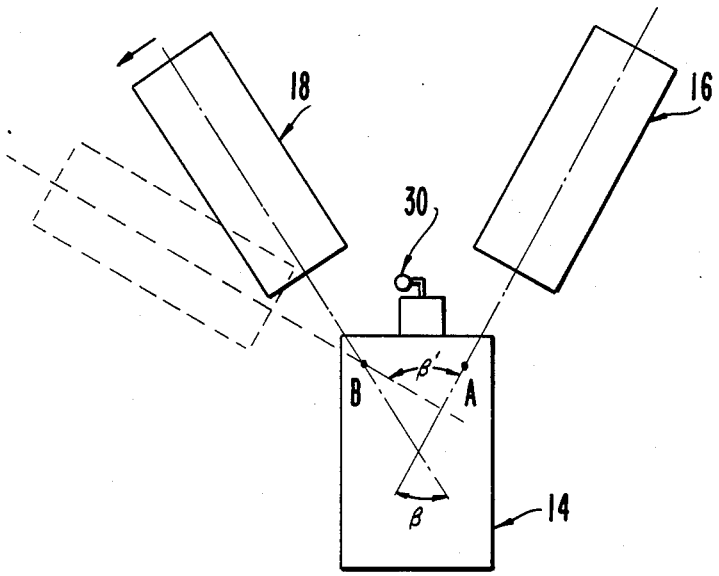
FIG. 2B is a top representational view of the present invention with the right leg support in the fixed position with the left leg support moving under operation of the crank actuation and crank assembly pivoting movement.

FIG. 2B illustrates shift selector 30 pointed towards the side to be stretched and away from the side to be locked. As will become clearer by reference to FIG. 6, the shift selector 30 locks one of the leg supporting means (in FIG. 2B, supporting means 16) into a specific position such that it cannot rotate about its respective pivot point in the plane of the leg supporting means. However, shift selector 30 points towards the leg supporting means which is still capable of providing leg stretching movement when the crank 20 is operated or the crank assembly housing 22 is pivotally moved. Thus, it can be seen that while an operator's torso and right leg will remain relatively fixed with respect to the apparatus (as shown in FIG. 2B), operation of the crank 20 in the proper direction will provide leg stretching movement in the direction of the arrow. This leg stretching movement by only leg supporting means 18 will tend to stretch only the left leg even though the angle between both leg supporting means increases from $\beta$ to $\beta'$. This mode of operation, whether the left or right leg supporting means, is defined as a single leg operating mode.

Figure 3:
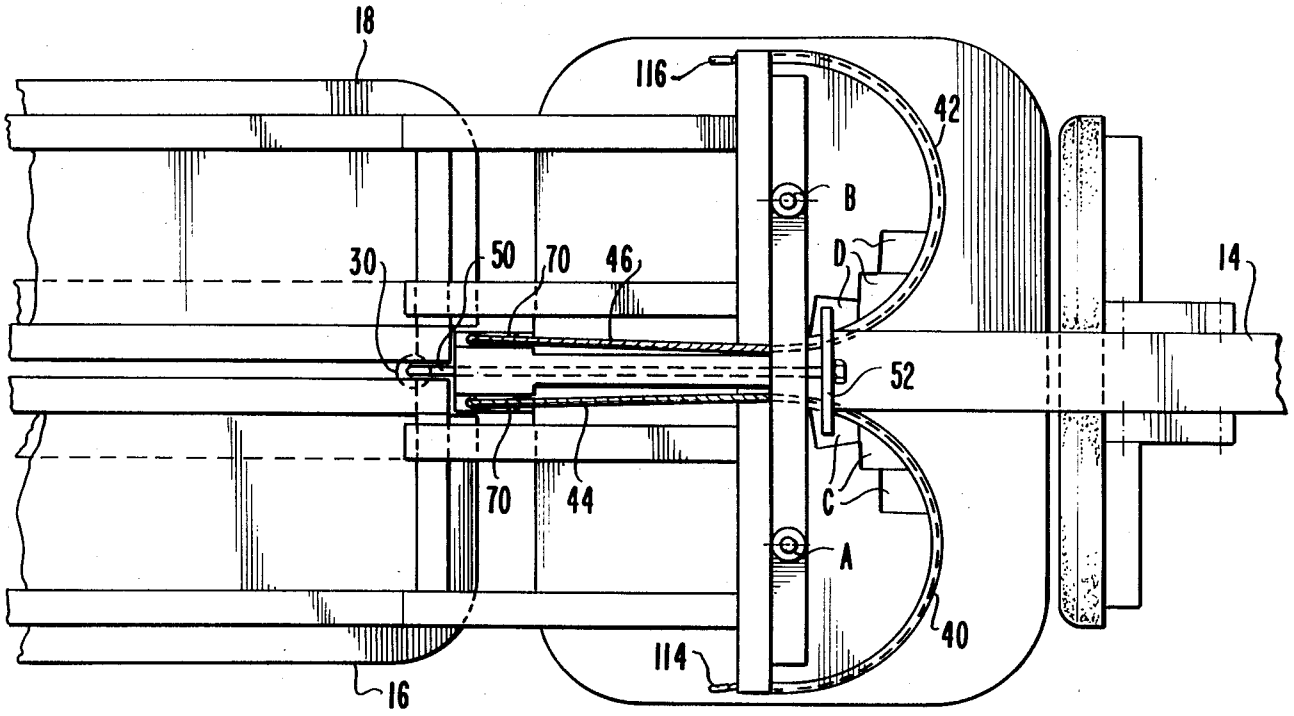
FIG. 3 is a bottom view of the present invention illustrating details of the steel tube frame and steel torque disk assembly.

FIG. 3 is a bottom view of the steel tube structure of the present preferred embodiment illustrating the torque disks 40 and 42. These may be simply circular or non-circular channels for retaining cables 44 and 46, at a desired radial distance from the pivot points A and B of leg supporting means 16 and 18, respectively. It can be seen that as cable 44 is pulled to the left, leg supporting means 16 will move downward and counterclockwise around pivot point and leg supporting means 18 will move upward in a clockwise direction around pivot point B. Thus, the movement of cables 44 and 46 to the left provide the leg stretching movement in much the same manner as disclosed in the copending patent application discussed above. Although shift selector 30 is only partially visible, rod 50 extends substantially parallel to the longitudinal axis of the leg stretching apparatus and is received into shift fork 52. A better view of the operation of shift fork 52 and its cooperation with the torque disks can be seen in FIG. 6.

Figure 6:
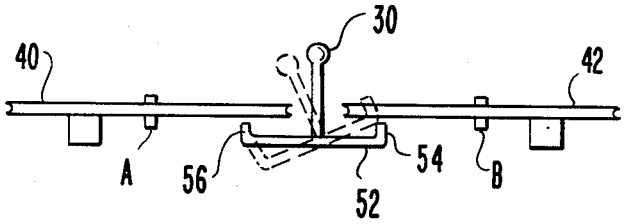

FIG. 6 is a rear view showing only the shift selector 30 and shift fork 52 operating in conjunction with torque disks 40 and 42. The solid line configuration confirms to the twist mode of operation as shown and disclosed in FIG. 2A and the phantom line configuration corresponds to the single leg mode of operation shown in and discussed with reference to FIG. 2B. As can be seen in FIG. 3, the torque disks have apertures C and D into which projections 54 and 56 on either side of the shift fork 52 can fit, depending upon which way shift selector 30 is moved. In a solid torque disk, these apertures may be holes drilled through the disk, while in one embodiment they are apertures created by welding triangular-shaped metal rods to the inner periphery of the torque disks, as shown in FIG. 3. As can clearly be seen in FIG. 6, when shift selector 30 is in the center or twist mode of operation position, neither projection 54 nor projection 56 intrudes into its respective apertures and thus they do not interfere with movement of either torque disk around its respective pivot point. However, if a single leg mode of operation is desired, the operator merely moves shift selector 30 to the side where leg stretching movement is desired and the projection on the opposite side (54 in the illustrated example) will intrude into one of the apertures (D in the example), preventing further movement of that torque disk and consequently that leg supporting means. Because three separate apertures have been provided in each torque disk, there are at least three separate positions that each leg supporting means could be locked into, depending upon where the leg supporting means was when the shift selector is moved to single leg operation.

Obviously, in view of the disclosure contained in FIGS. 3 and 6, many other devices will be readily apparent for locking one leg supporting means into a desired fixed position with respect to base assembly 14. For example, the periphery of the torque disk could have a number of teeth or slots into which a movable dog is received when the desired fixed position is set by the shift selector. Thus, it would be obvious to one of ordinary skill in the art, aided by the present disclosure, to provide any one of a multitude of interrelating structures for locking an individual leg supporting means as set forth herein.

Figure 4:
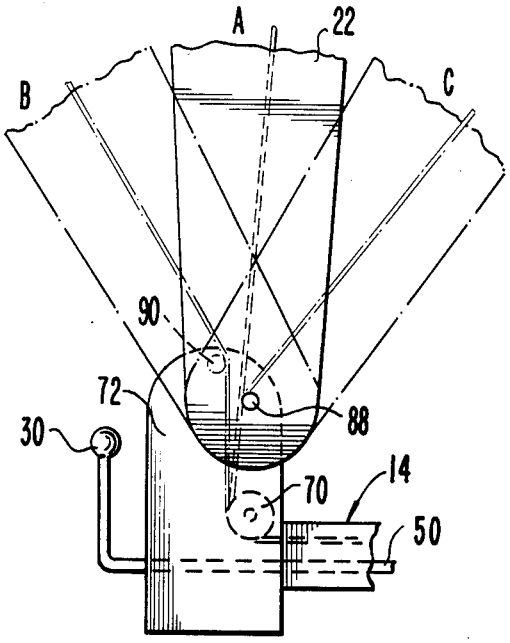
FIG. 4 is a side view illustrating the pivoting crank assembly housing.

FIG. 4 discloses the minor modifications to the mount 72 in accordance with the present invention. It also illustrates how movement of the crank assembly housing 22 provides for a minor portion of leg stretching movement by a slight increase in the path length of the cable as it moves around pivot 88 and separate roller means 90. This operation is more clearly disclosed in the copending application with reference to FIG. 3. The guide means 70, mount 72, pivot 88, and roller means 90 are commonly identified in the present FIG. 4 and in FIG. 3 of the copending application, and the discussion relating to FIG. 3 in the copending application is herein incorporated by reference. Further, it can be seen that shift selector 30, when moved in and out of the plane of the drawing of FIG. 4, will cause a rotational movement of shaft 50 and accordingly move shift fork 52 for either engagement or disengagement with the apertures C and D, as previously discussed.

Figure 5:
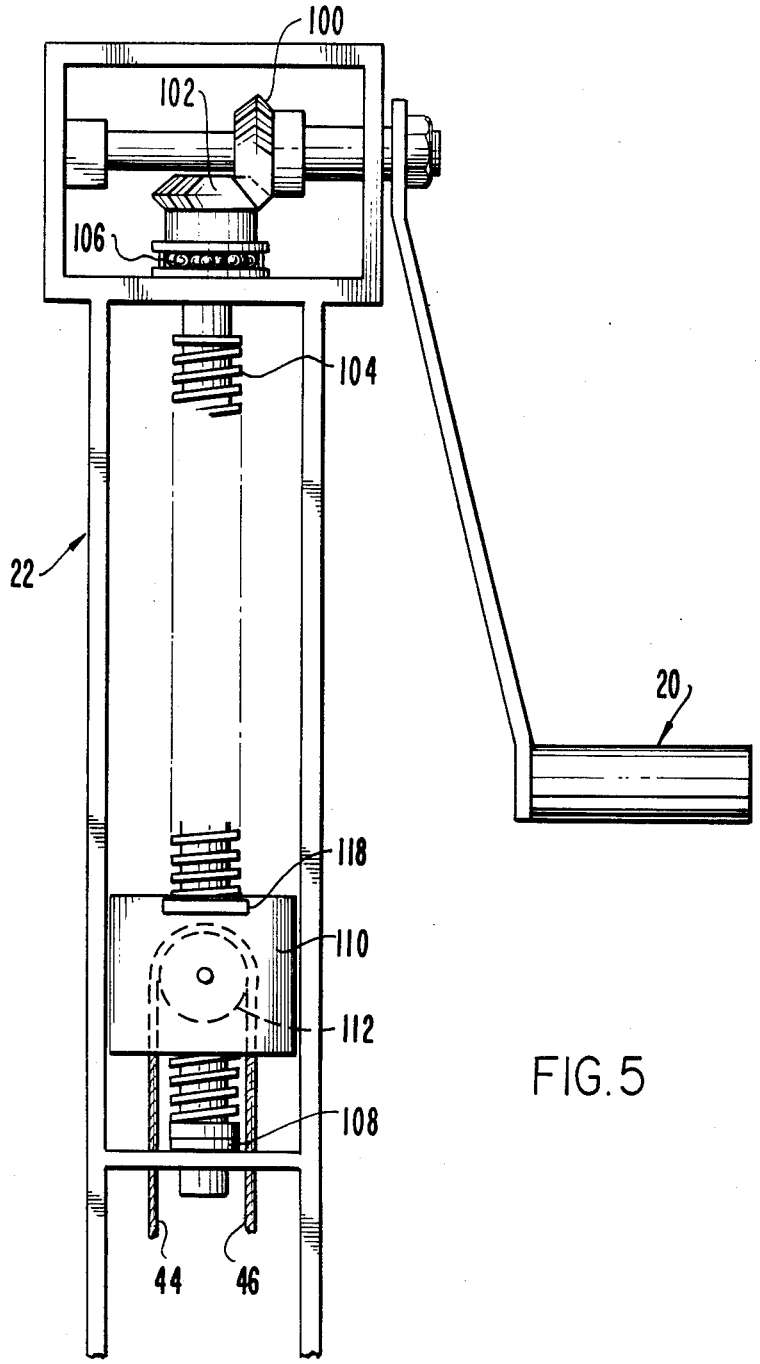
FIG. 5 is a rear view of the crank assembly housing with a protective cover removed; and, FIG. 6 is a side view showing only the interaction of the torque disks with the leg stretching shift selector.

FIG. 5 illustrates an improved crank assembly contained in crank assembly housing 22. Bevel gears 100 and 102 provide rotation of worm gear 104 when crank handle 20 is rotated. Rotation of worm gear 104 is aided by thrust bearing 106 and bushing 108 at either end thereof. The worm gear is threadably received through block 110, which is constrained against rotation, but which is free to move along the axis of worm gear 104. Block 110 includes pulley 112 around which the cable passes. It is anticipated that cables 44 and 46 are joined as one continuous cable length extending from cable anchor 114 associated with leg supporting means 16 over pulley 112 and back to cable anchor 116 associated with leg supporting means 18. It will be seen that upward movement of pulley 112 (caused by proper rotation of crank handle 20 and worm gear 104) will pull cable segments 44 and 46 to the left in FIG. 3, causing a leg stretching movement. Further, once the amount of leg stretching movement is fixed, the pulley 112 allows cable segments 44 and 46 to move thereabout, permitting the twist mode of operation which substantially fixes the angle $\alpha$ between the two leg supporting means, as shown in FIG. 2A. It can further be seen that even if one leg supporting means is fixed in position by the operation of shift selector 30, crank operation will still cause movement of pulley 112 and increase the tension on the movable leg supporting means, facilitating the single leg mode of operation as disclosed in FIG. 2B.

In a preferred embodiment of the present invention, visual indicia 118 may be mounted on block 110 and may be visible to the operator with a cover on the crank assembly housing (said cover not shown). Obviously, if indicia 118 comprised a white mark and the crank assembly housing cover had a slot therein which extended parallel to the axis of worm gear 104, the operator could perceive the position of the block 110 in the crank assembly housing 22, thereby providing a relatively accurate indication of the angle between the two leg supporting means, regardless of whether shift selector 30 was in the twist mode or in the single leg mode of operation.

In a preferred embodiment, the threads selected for worm gear 104 and block 110 are such that they are much like the threads on a scissors-type automotive jack so that crank handle 20 may be released at any stretch angle and with any degree of force being applied to the leg supporting means without spinning around under the influence of the tension on cable segments 44 and 46. This provides an additional safety feature over the drum assembly illustrated in FIG. 4 in the copending application in the event that the spring-biased ratchet 82 should become disengaged from drum 80, which would allow a handle to spin at a high rate of speed, possibly injuring the operator.

Obviously, in view of the above disclosure, there are numerous modifications to the above structure and indeed different structures which will provide an easily controlled movement of pulley 112 which, in turn, causes the major leg stretching movement in the device. Although a preferred embodiment utilizes a simple welded steel housing, many well-known structural materials such as aluminum, FRP, and others could be used if so desired without deviating from the present invention.

In addition to the ability to operate in either the twist mode or single leg mode, the present invention incorporates an adjustable position seatback 12 which can be moved fore and aft along the base assembly by repositioning pin 120 in one of a number of holes 122. Furthermore, the angle of the seatback can be changed by removal and relocation of pin 124 in holes 126. Removal of one of these pins permits the seatback to be folded flat and when the leg supporting means are moved to lie along base 14, the entire assembly provides a very compact arrangement for storage purposes.

It will be clear in view of the above disclosure that the present invention can be modified in many of the same ways in which the copending application indicates that it can be modified with regard to construction materials, structural geometry, use of cables, or gear drives, etc. Additionally, while in the present invention it is beneficial to provide two means for providing leg stretching movement (the crank means providing the major portion of leg stretching movement and the crank assembly housing pivot providing a minor portion of leg stretching movement), the present invention could be utilized to good effect on a leg stretching apparatus which only provided a single source of leg stretching movement. It is clear that the present invention, by the elimination of the worm gear in the fixing of pulley 12 in position, movement of the crank assembly housing would provide the leg stretching movement and also permit the benefits of the twist mode and single leg modes of operation. Similarly, crank assembly housing 22 could be made integral with base assembly 14 so that the crank 20 provides the only leg stretching movement. Although this would not provide the fine tuning available in the preferred embodiment, this would permit the twist mode and single leg modes of operation in accordance with the present invention. Although the above are believed less desirable modifications, they may be of interest in extremely simplified versions of applicant's invention, and are included within the scope of the present disclosure.

Therefore, and in view of the above teachings, many modifications and applications of the present invention will be obvious to those of ordinary skill in the art. The invention is not limited to the specific examples and embodiments expressed herein, and is limited only in accordance with the accordance with the appended claims.

The embodiments of the invention in which an exclusive property or privilege is claimed are defined as follows:

1. An apparatus for stretching only one joint of a person in a given direction of motion to facilitate greater flexibility and lower risk of injury during joint movement in said direction of motion, said apparatus comprising:

a first means for retaining a first portion of said person, said first poriton located on at least one side of said one joint;

a second means for retaining a second portion of said person, said second portion located on at least another side of said one joint;

means for stretching said joint in said given direction of motion, said stretching means comprising a first means for providing a first stretching movement in said given direction and a second means for providing a user-controlled second stretching movement in said given direction, wherein said one joint in said person comprises a hip joint, said stretching movement direction of motion is in a direction tending to spread said person's legs apart towards a "split" condition, said first portion of said person comprises one leg of said person, and said second portion of said person comprises the torso, hip and other leg of said person, wherein said first retaining means comprises a first means for restraining said one leg against movement in a direction towards said other leg, and said second retaining means comprises a second means for restraining said torso, hip and other leg against movement in a direction towards said one leg, wherein only said one leg moves under the influence of said stretching means.

2. An apparatus for stretching at least one joint of a person in a given direction of motion to facilitate greater flexibility and lower risk of injury during joint movement in said direction of motion, said apparatus comprising:

a first means for retaining a first portion of said person, said first portion located on at least one side of said at least one joint;

a second means for retaining a second portion of said person, said second portion located on at least another side of said at least one joint; and means for stretching said joint in said given direction of motion, said stretching means comprising a first means for applying a force substantially equally to said first and second portions of said person, for providing a first stretching movement in said given direction and a second means for applying a force substantially equally to said first and second portions of said person, for providing a user-controlled second stretching movement in said given direction.

3. An apparatus for stretching at least one joint of a person in a given direction of motion to facilitate greater flexibility and lower risk of injury during joint movement in said direction of motion, said apparatus comprising:

a first means for retaining a first poriton of said person, said first portion located on at least one side of said at least one joint;

a second means for retaining a second portion of said person, said second portion located on at least another side of said at least one joint;

means for stretching said joint in said given direction of motion, said stretching means comprising a first means for providing a first stretching movement in said given direction and a second means for providing a user-controlled second stretching movement in said given direction, wherein said first stretching movement means is a hand crank mounted on a crank housing and said second stretching movement means is the crank housing.

4. The apparatus according to one of claims 2 or 3, wherein said at least one joint in said person comprises two hip joints, said stretching movement direction of motion is in a direction tending to spread said person's legs apart towards a "split" condition, said first portion of said person comprises one leg of said person, and said second portion of said person comprises said other leg of said person, wherein said first retaining means comprises a first means for restraining said one leg against movement in a direction towards said other leg, and said second retaining means comprises a second means for restraining said other leg against movement in a direction towards said one leg.

5. A leg stretching apparatus for stretching the legs of a person into a "split" condition, said leg stretching apparatus comprising:

a lower torso retaining means for retaining the lower torso of the person using the apparatus; and means for providing a leg stretching movement, said movement having a component directed rearward of said person tending to spread said person's legs apart, said means for providing including two elongate leg supporting means, one for each leg of said person, and means for releasably locking only one of said elongate leg supporting means into a fixed position with respect to said lower torso retaining means.

6. The leg stretching apparatus according to claim 5, wherein said means for releasably locking only one of said elongate leg supporting means into a fixed postiion with respect to said lower torso retaining means further includes means for permitting the other of said elongate leg supporting means to move under the influence of said leg stretching movement.

7. A leg stretching apparatus for stretching the legs of a person into a "split" condition, said leg stretching apparatus comprising:

a lower torso retaining means for retaining the lower torso of the person using the apparatus; and means for providing a leg stretching movement, said movement having a component directed rearward of said person tending to spread said person's legs apart, said providing means including two elongate leg supporting means, one for each leg of said person and means permitting movement of said leg supporting means in a single plane while maintaining substantially constant the angular relationship between said two elongate leg supporting means.

8. The leg stretching apparatus according to claim 5 or 7, wherein said providing means includes means for providing an initial stretch position and a user-controlled adjustment means for providing a leg stretching movement, said adjustment means comprising a means for adjusting the leg stretching movement independent of said initial position providing means operation.

9. The leg stretching apparatus according to claim 8, wherein said means for providing an initial stretch position comprises a crank means for providing a first leg stretching movement and said adjustment means provides a second leg stretching movement.

10. The apparatus according to claim 9, wherein said leg stretching movement providing means comprises:

two elongate leg supporting means, one for each leg of said person using the leg stretching apparatus;

means for pivotally mounting each of said leg supporting means to said torso retaining means for movement in a generally horizontal plane;

means for housing a crank assembly; and means for pivotally mounting said crank assembly housing means to said torso retaining means for pivotal movement in a generally vertical plane.

11. The apparatus according to claim 10 wherein each of said leg supporting means includes a cable, and a cable mounting means, mounting one end of said cable, for generating said leg stretching movement when said cable is pulled, said other end of each of said cables being connected to said crank means, the operation of said crank means pulling on said cable.

12. The apparatus according to claim 11, wherein said leg stretching movement providing means further includes guide means for redirecting said cables from a generally horizontal plane to a generally vertical plane, and said crank assembly housing pivotal mounting means located substantially intermediate said guide means and said crank means.

13. The apparatus according to claim 12, wherein said adjustment means comprises:

roller means, located substantially intermediate said guide means and said crank means, for lengthening the cable path from said guide means to said crank means when said crank assembly housing means is pivoted away from an initial position.

14. The apparatus according to claim 13, wherein said housing means pivots in the forward and rearward directions, said initial position is a substantially vertical orientation of said housing means, and said roller means comprises:

a first roller means, fixed with respect to said guide means and located just forward of said cables from said guide means to said crank means when said housing means is in said initial position, for contacting said cable when said housing means is pivoted in said forward direction; and a second roller means, fixed with respect to said guide means and located just rearward of said cables from said guide means to said crank means when said housing means is in said initial position, for contacting said cables when said housing means is pivoted in said rearward direction.

15. The apparatus according to claim 14, wherein said second roller means comprises said pivotal mounting means.

16. The apparatus according to claim 5 or 7, wherein said lower torso retaining means includes a seat and backrest assembly.

17. The apparatus according to claim 10, wherein each of said leg supporting means includes a horizontal, longitudinally extending portion and said cable mounting means comprises a portion of a disk, said disk portion affixed to said horizontal, longitudinally extending portion, said center of said disk portion coincident with said leg supporting means pivot, each of said disk portions including means defining a groove around at least a portion of the periphery of said disk, said groove mounting said cable.

18. The apparatus according to claim 5 or 7, wherein said leg stretching providing means comprises means, cantilevered from said lower torso retaining means, for providing a leg stretching movement having a component directed rearward of said person using said apparatus, said movement tending to spread said person's legs apart.

19. The leg stretching apparatus according to claim 9, including means for providing a visual indicia of the relative angle between said two elongates leg supporting means.

20. The leg stretching apparatus according to claim 10, wherein each of said leg supporting means includes a cable segment and a cable mounting means, mounting one end of said cable segment, for generating said leg stretching movement when said cable is pulled, said providing means further including means for tensioning cable segments.

21. The leg stretching apparatus according to claim 20, wherein said cable segments comprise a single cable and said tensioning means comprises a pulley over which said cable passes and a means for moving said pulley in a direction which changes the tension in said cable.

22. The leg stretching apparatus according to claim 21, wherein said moving means comprises:

a block, slidable in said housing means, mounting said pulley;

worm gear means for sliding said block in said housing means when said worm gear means is rotated; and bevel gear means for connecting said crank means to said worm gear means and for transforming rotational movement of said crank means into rotational movement of said worm gear means.

23. The leg stretching apparatus according to claim 5, wherein said means for providing includes two elongate leg supporting means, one for each leg of said person using the apparatus and said releasable locking means comprises a shift selector means for controllably engaging one of said leg supporting means and for preventing movement thereof when engaged.

24. The leg stretching apparatus according to claim 23, wherein each of said two elongate leg supporting means includes a horizontal, longitudinally extending portion mounted for pivotal movement with respect to said torso retaining means, and said shift selector means is located on said torso retaining means, and includes means, removably insertable into one of said leg supporting means, for controllably preventing pivotal movement of said horizontal longitudinally extending portion.

* * * * *